United States Patent [19]

Noro et al.

[11] 4,137,674

[45] Feb. 6, 1979

[54] METHOD OF CONCENTRIC GRINDING

[75] Inventors: Shuhei Noro, Aichi; Kunio Hayashi, Nagoya; Yoshisada Wada, Toyota, all of Japan

[73] Assignee: Toyota Jidosha Kogyo Kabushiki Kaisha, Toyota, Japan

[21] Appl. No.: 774,421

[22] Filed: Mar. 4, 1977

[30] Foreign Application Priority Data

Mar. 9, 1976, [JP] Japan ..... 51-025362

[51] Int. Cl.[2] ..... B24B 1/00

[52] U.S. Cl. ..... 51/281 R; 51/289 R; 279/2 R; 269/48.1; 51/227 R

[58] Field of Search ..... 51/227 R, 281 R, 289 R; 279/2 R; 269/48.1

[56] References Cited

U.S. PATENT DOCUMENTS

| | | | |
|---|---|---|---|
| 1,976,109 | 10/1934 | Archea | 279/2 |
| 2,698,551 | 1/1955 | Olsen | 51/227 R |
| 2,922,592 | 1/1960 | Kaltenbach | 279/2 X |
| 3,792,856 | 2/1974 | Hernandez | 269/48.1 |

FOREIGN PATENT DOCUMENTS

| | | | |
|---|---|---|---|
| 645529 | 11/1950 | United Kingdom | 279/2 |

*Primary Examiner*—Harold D. Whitehead
*Attorney, Agent, or Firm*—Brisebois & Kruger

[57] ABSTRACT

A holder for use in cutting the outside surface of a cylindrical blank, the inner bottom of which has a concave spherical seat, to make said outside surface concentric with said concave spherical seat, characterized in that a rotatable shaft of a smaller outside diameter than the inner diameter of said blank and having a tip bearing against said concave spherical seat is provided longitudinally with three equi-distant grooves. A concave spherical surface is formed at the bottom of each of said grooves and this surface has a concave spherical surface of radius R with its axis running at right angles to the longitudinal direction of said rotatable shaft. In each groove of said shaft is slidably inserted an expansion pawl having at its top a projection bearing against the inside surface of said blank and having at its bottom a convex spherical surface of radius r (R > r). The invention includes a method of correcting concentricity by using said holder.

2 Claims, 7 Drawing Figures

METHOD OF CONCENTRIC GRINDING

BACKGROUND OF THE INVENTION

A valve-lifter may be mentioned as an example of products which need a process for cutting the outside surface of the blank and making said outside surface concentric with a concave spherical seat in the inside of its bottom.

To avoid the need for machining the concave spherical internal seat, this seat is formed, in accordance with the invention, by casting, or forging. To cast the seat, a steel ball is provided at the end of the core in a mold in which the hollow cylindrical valve lifter body blank is cast. Where the seat is forged, and forging can be hot or cold forging, and the seat is formed by a forging punch with a spherical tip. After the rough body blank is formed its exterior surface is correctively cut to make this exterior surface concentric with the internal spherical seat.

In accordance with this invention the rough blank, with its concave internal seal formed during casting, or by forging, is mounted on a unique holder which centers the blank with respect to the axis of the concave seat and permits reliable corrective cutting of its outside surface concentric with the seat. The technique of the invention simplifies forming the cylindrical body by eliminating the need for machining the concave seat.

SUMMARY OF THE INVENTION

The present invention relates to a holder for corrective cutting to make the outside surface of a cylindrical blank having a concave spherical seat in the inner surface of its bottom concentric with said concave spherical seat; and to a method of corrective cutting utilizing said holder.

DETAILED DESCRIPTION OF THE INVENTION

According to the present invention, a cheap cylinder with high concentricity can be obtained by correctively cutting its outside surface to make it concentric with the concave spherical seat on the inner surface of its bottom. In this process, the concave spherical seat is formed at the same time that the blank is manufactured and said blank is finished into a cylinder of high concentricity by the following steps:

(1) Blank having a concave spherical seat → (2) corrective cutting of its outside surface for concentricity with the concave spherical seat → (3) rough centerless grinding of outside surface → (4) rough cutting (grinding) of cam contact surface as reference fo concave spherical seat and outside surface followed by finish cutting (grinding) → (5) finish centerless grinding of outside surface → (6) cylinder (end product).

Now step (2) according to the present invention will be discussed.

Figure 1A:
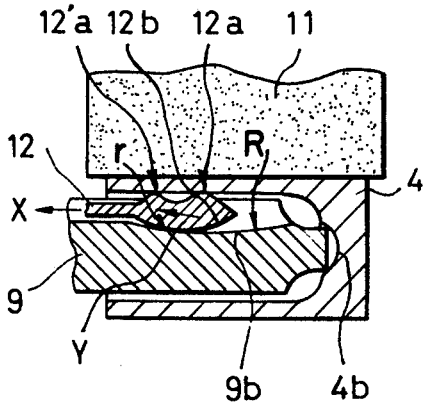
FIG. 1A is a sectional view of the holder according to the invention holding a blank.
Figure 1B:
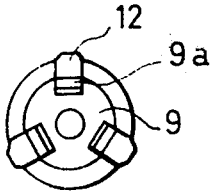
FIG. 1B is a front elevational view of the invented holder.
Figure 2:
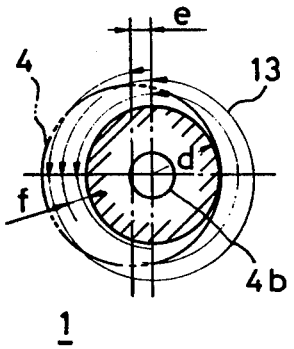
FIG. 2 is a diagram explaining the process of corrective cutting of a blank for concentricity by means of a holder according to the present invention.

The present invention will be described with reference to FIG. 1A which is a sectional view of a blank being held in the holder for corrective cutting for concentricity according to the invention and to FIG. 1B which is a front elevation view of said holder.

The holder according to the present invention is so constructed that on the rotatable shaft 9 having a smaller outside diameter than the inside diameter of the blank 4 are cut three equi-spaced grooves **9*a* in the longitudinal direction of said rotatable shaft 9, each groove having at its bottom a concave curved surface 9*b* with radius R about an axis at right angles to the longitudinal direction of the rotatable shaft. An expansion pawl 12 having at its top a projection 12*a* in contact with the inside surface of the blank 4 and having at the bottom a convex curved surface 12*b* with radius r (R being greater than r) is slidably inserted in said groove 9*a***.

In the figures, the projections **12*a* from the expansion pawl 12 are two, but one projection may suffice and its area contacting the inside surface of the blank 4** has only to be about 1 $mm^2$.

In the use of the holder according to the invention for corrective cutting for concentricity, first the tip of the rotatable shaft 9 is placed against the concave spherical seat **4*b* of the blank 4; then the expansion pawl 12 is pulled in the direction X of the rotatable shaft 9; the projection 12*a* of the expansion pawl 12 is pressed against the inside surface of the blank 4 to hold the blank 4; and in this state the outside surface of the blank 4 is cut by the tool 11 for correction of concentricity with the concave spherical seat 4*b***.

When the X-direction pull of the expansion pawl 12 is provided by using a spring or a hydraulic cylinder, the variation in the cast texture of the inside surface of the blank 4 can be absorbed and the blank 4 can be reliably attached to the rotatable shaft 9. A rolling grindstone or rolling emery paper makes an adequate tool 11.

In the holder according to the present invention, the inside surface of the blank 4 is strongly pressed by the preferably three projecting points **12*a* of a projecting area of about 1 $mm^2$ provided at the top of the expansion pawl 12. Therefore even if the inside surface has a rough-cast texture full of asperities or the roundness or cylindricity of the inside surface is somewhat poor, the blank 4 can be reliably attached to the rotatable shaft 9. Since the convex curved surface 12*b* of the expansion pawl 12 and the concave curved suface 9*b* of the groove provided on the rotatable shaft are in linear contact with each other, there is little possibility of a foreign body getting in. Meanwhile, since the tip of the rotatable shaft 9** can be thick enough (only the grooved part is narrow as compared with the conventional shaft), said tip is not likely to deflect under the force used in the corrective cutting and accordingly the blank can be held with high rigidity. Thus the concentricity does not deteriorate.

Figure 4:
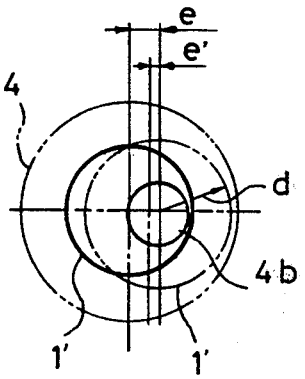
FIG. 4 is a diagram showing a blank held in the holder according to the invention during further progress in corrective-cutting.
Figure 5:
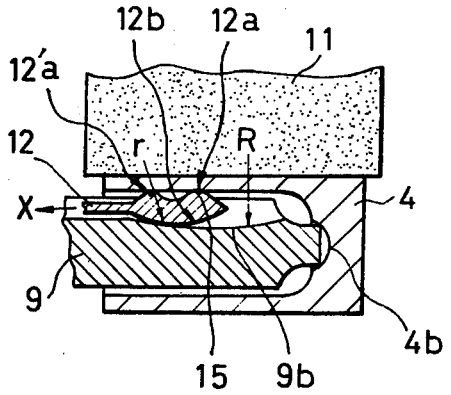
FIG. 5 is a sectional view of a blank held in the invented holder according to the invention with a contact ball pressed in at the projection of the expansion pawl.

In the corrective cutting of the blank as illustrated in FIG. 4 showing the cutting process, the blank 4 with eccentricity e referring to the concave spherical surface is cut by the tool at a rate of f depth per rotation of the tool and the cutting is stopped at a position of radius d from the center of the concave spherical seat, thereby yielding a cylinder 1 having an outside surface with radius d from the center of the concave spherical seat; and when said cylinder is submitted to centerless grinding, a cylinder 1 with corrected concentricity can be obtained. It goes without saying that said corrective cutting can be executed using a conventional grinder. In the figure reference numeral 13 denotes the cutting orbit of the rolling tool.

In the above method, the blank is cut by the tool at a rate of f depth per rotation of the tool, but the concentricity may be corrected otherwise.

For instance, gravity-cutting is done using a rolling tool with a dead load, whereby the cutting follows only the profile of the blank and no correction of concentricity is made. In this case the concentricity can be corrected by preventing the tool from cutting through a stopper provided in the direction of cutting.

Figure 3:
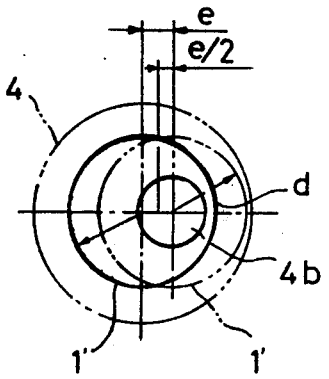
FIG. 3 is a diagram showing a blank held in the holder according to the invention and being cut for concentricity correction.

In FIG. 3, reference numeral 4 indicates the profile of the blank. When only gravity-cutting of the blank by the tool is done, in a certain working time the blank is cut to the profile indicated by the solid line 1' with a radius d relative to the center of said profile 4 and no correction of concentricity is achieved. If a stopper is provided for the tool so that the tool cannot cut deeper than the radius d from the center of the profile 4*b*, the machined profile will not be one indicated by the solid line 1' but will be one with its right half following the dot-chain line 1' and the eccentricity can be corrected from e to e/2.

FIG. 4 shows a case in which gravity-cutting is continued by the tool with the stopper set as it is, whereby the concentricity is further improved to e' ($e' < e/2$).

Centerless grinding of a blank having the profile 1' yields a cup-shaped cylinder with corrected concentricity. With further progress of gravity-cutting by the tool with the stopper set as it is, e' comes closer to zero.

Thus, corrective cutting can be carried out depending on the required concentricity of the cup-shaped cylinder; and corrective cutting can be accomplished considering the tolerance in the concentricity of the cylinder (product) and the machining cost.

As described above, the invented holder for corrective cutting for concentricity enables precise manufacture of a cup-shaped cylinder such as the valve-lifter of an internal combustion engine which is required to have high concentricity between the concave spherical seat at the inside bottom and the outer surface.

In the invented holder, as illustrated in FIG. 1, when the expansion pawl 12 is pulled in the direction X, said pawl 12 moves in the direction Y following a lift curve of R–r and thereby the blank 4 can be attached to the rotatable shaft 9. Thus the blank 4 is held by the projection 12*a* of the expansion pawl and accordingly said projection 12*a* should be durable and harder than the blank 4. Meanwhile it is desirable that said projection 12*a* and the blank 4 be in point contact with each other and said projection be of such a shape that it can easily cut into the blank 4.

In FIG. 1 there are two projections 12*a* on the expansion pawl 12. When the blank 4 is supported uniformly on said projections 12*a*, 12*a*', the blank 4 can be firmly held. When the projections 12*a*, 12*a*' differ in height and size, depending on the surface roughness, concentricity and cylindricity of the inside surface 14 of the blank 4, an excessive force acts on either of the projections and in consequence the expansion pawl 12 tilts and bends in relation to the rotatable shaft. If, in this state, the blank 4 is mounted and cut by the tool 11, the projections 12*a*, 12*a*' will be broken or abnormally worn.

To prevent this, attempts have been made to mitigate the tilting of the expansion pawl by narrowing the distance between the projections 12*a* and 12*a*' or by providing only one projection 12*a*, but even this cannot prevent the breaking or abnormal wear of the projections, because the X-direction shift of the contact points 12*a*, 12*a*' during the cutting process in dependence on the plastic deformation of the blank causes a corresponding force to be developed.

The present invention has been made in order to hold the blank 4 better, and thereby prevent said projection 12*a* from being broken or abnormally worn.

According to the present invention, there is a rotatable shaft 9 having its outer diameter smaller than the inner diameter of a cylindrical blank 4 having a concave spherical seat 4*b* in the inner surface of its bottom or its equivalent. In the tip of said shaft contacting said concave spherical seat 4*b*, there are three longitudinal approximately equi-distant grooves 9*a* on the circumference of said shaft 9, so arranged that the bottom of each groove has a curved surface with radius R about an axis at right angles to the longitudinal direction of the rotatable shaft 9 or equivalent concave curved surface 9*b*. An expansion pawl 12 having at its top a projection 12*a* which contacts the inside surface 14 of said blank and having at its bottom a cylindrical surface with radius r ($R > r$) or an equivalent convex curved surface 12*b* is provided slidable along said groove 9*a*. In a holder for corrective cutting of the outside surface of said blank 4 to make it concentric with said concave spherical seat 4*b*, a spherical hole 16 is bored at the tip of the projection 12*a* which contacts the inside surface of said blank 4, and a ball of wear-resistant material such as a steel ball or a superhard ball (hereafter to be called contact ball) 15 is seated in said hole 16. Said contact ball 15 is brazed to the tips of projections 12*a*, 12*a*' of said expansion pawl after being pressed in or inserted or stuck there by plastic working.

If the convex surface 12*b* of the expansion pawl 12 is hardened by quenching, the holder will become more wear-resistant.

Figure 6A:
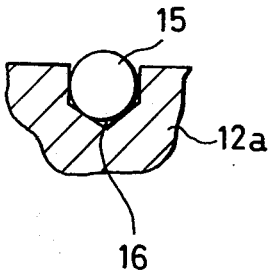
FIG. 6A and B are sectional views of the tip of said projection.
Figure 6B:
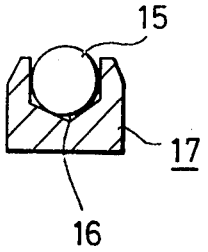

As described above, when a hole 16 is bored as shown in FIG. 6A at the projections 12*a*, 12*a*', a commercial mass-produced contact ball 15 can be easily pressed or shrink-fitted into said hole 16 and then brazed, or it may be stuck there by plastic working. As illustrated in FIG. 6B, an expansion pawl 12 with the same effect may be obtained by screwing into said hole 16 at the projection 12*a* an assembly of pressed-in contact ball 15.

When the blank 4 is held in the holder according to the present invention using an expansion pawl 12 with a contact ball 15 provided at its projection 12*a*, in the corrective cutting of the outside surface of the blank 4 a smooth movement in the direction X of the projections 12*a*, 12*a*' can take place depending on the plastic deformation of the blank. Thus with the holding action stabilized, breaking or wear of the projections 12*a*, 12*a*' can be prevented, resulting in safety of working and long life of the holder.

What is claimed is:

1. Method of corrective cutting of a rough cylindrical blank for a valve-lifter of an internal combustion engine comprising the following steps:

forming a rough cylindrical blank having a concave spherical seat on the inner surface of its bottom by casting or forging and coining with a steel ball;

applying a holder comprising a rotatable shaft with its outer diameter smaller than the inner diameter of said blank, said shaft having a tip, and three circumferential substantially equidistant longitudinal grooves, with the bottom of each groove having a cylindrical surface with radius R about an axis at right angles to the longitudinal direction of said shaft, and an expansion pawl having at its top a projection which contacts the inside surface of said blank and having at its bottom a cylindrical surface with radius r ($R > r$) or an equivalent convex curved surface and is slidable along said groove, so that the tip of the rotatable shaft contacts said concave spherical seat of said blank;

pulling said expansion pawl through a spring connected to the expansion pawl axially of the rotatable shaft, whereby the blank is fixed coaxially to the rotatable shaft as the result of the projection of said expansion pawl against the inside surface of the blank;

and then cutting said blank to make its outside surface concentric with said concave spherical seat of said blank.

2. Method of claim 1 in which a gravity-cutting tool is used and in which a stopper is provided so that said tool in working cannot come closer to the blank than a predetermined distance.

* * * * *